United States Patent [19]

Briles

[11] 3,934,330

[45] Jan. 27, 1976

[54] REVERSE END RIVETING SYSTEM AND METHOD

[76] Inventor: Franklin S. Briles, 3600 Catamaran, Corona Del Mar, Calif. 92625

[22] Filed: Mar. 28, 1974

[21] Appl. No.: 455,555

[52] U.S. Cl. ..... 29/509; 29/243.54

[51] Int. Cl.[2] ..... B21D 39/00

[58] Field of Search ..... 29/505, 509, 522, 526, 29/243.53, 243.54, 432, 432.1, 432.2; 227/7, 56, 61, 62; 72/391, 386, 396, 460, 465

[56] References Cited

UNITED STATES PATENTS

| | | | |
|---|---|---|---|
| 2,515,674 | 7/1950 | Tisie | 29/243.54 |
| 2,539,419 | 1/1951 | Harcourt | 29/243.54 |
| 2,797,596 | 7/1957 | Seely | 29/243.54 |
| 3,432,925 | 3/1969 | Woolley | 29/243.54 |
| 3,557,442 | 1/1971 | Speller | 29/243.54 |
| 3,574,918 | 4/1971 | Focht | 29/243.54 |
| 3,581,373 | 6/1971 | Murdoch et al. | 29/243.54 |
| 3,609,851 | 10/1971 | McMaster et al. | 29/243.54 |
| 3,747,194 | 7/1973 | Christensen | 29/243.54 |

*Primary Examiner*—C. W. Lanham
*Assistant Examiner*—James R. Duzan
*Attorney, Agent, or Firm*—William W. Haefliger

[57] ABSTRACT

A metallic rivet is secured to work containing a work bore, the rivet having a head at one side of the work and an axially extending shank extending through the bore, the shank having a terminal protruding at the opposite side of the work. The method includes:

a. applying back-up force to the rivet head tending to urge the head toward the work, and b. delivering an impact to the rivet shank terminal in a direction tending to urge said terminal toward said bore, but with sufficient impact velocity as to radially expand and axially shorten the bulk of said terminal, thereby to form an upset engaging said opposite side of the work while the head remains in close adjacency to said one side of the work.

16 Claims, 3 Drawing Figures

REVERSE END RIVETING SYSTEM AND METHOD

BACKGROUND OF THE INVENTION

This invention relates generally to riveting processes and systems, and more particularly concerns riveting method and equipment facilitating more rapid and efficient riveting with associated substantial reduction in noise levels.

At the present time there are many problems involved in the riveting of panels, as for example in aircraft fabrication. Among these are the requirement for the delivery by a rivet gun of a large number of blows or impacts to the rivet head, in order to gradually upset the rivet shank terminal, a so-called heavy mass or "bucking bar" being held against that terminal to form the upset. Not only is this procedure extremely noisy, but it also produces rapid oscillation of the rivet back and forth in the panel bore during the riveting process, which tends to gall the bore and remove anodizing on the rivet shank due to back and forth frictional contact of the shank with the bore. Further, the impact shock loading or hammering is repeatedly delivered via the rivet head to the work panels, tending to separate them slightly at their interface, and resulting in an undesirably loose riveted connection and/or buckling of one or both panels, in many instances. Additional problems include unwanted flattening and cracking of rivet heads, marring of the panels, so-called clinching of the upset and tipping or cutting of the driven head.

SUMMARY OF THE INVENTION

It is a major object of the invention to provide solutions to the above problems, through the provision of the riveting method and system to be described. Basically, the method involves steps that include applying back-up force to the rivet head tending to keep the rivet in fully inserted position in the work, with the rivet head urged toward the work; and, delivering an impact to the protruding rivet shank terminal in a direction to urge the terminal toward the bore in the work, the impact delivered with such high impact velocity as to radially expand and axially shorten the bulk of the terminal, thereby to form an upset engaging the side of the work opposite the head, while the head remains in close adjacency to the work. Accordingly, major impact force is not transmitted to the work via the head, but is rather employed to directly form the upset, at such high speed that the rivet head is not undesirably displaced relatively away from the work. As will appear, the upset is preferably formed in response primarily to only a single impact, to reduce the noise levels to a minimum and to virtually eliminate rapid endwise oscillation of the rivet in the work during upset formation. Also, initial force (prior to impact) is exerted or applied against the work opposite sides in order to prevent separation of work panels during upset formation as described.

The method may also include the step of confining the tip of the rivet terminal against radial expansion while the bulk of that terminal undergoes radial expansion, thereby to form a centering indicator at the tip of the upset. An inspector can then readily ascertain, by viewing the indicator, whether or not the upset has been formed in centered relation to the rivet shank. Further, such confinement may be effected by interfitting an anvil with the rivet tip, and friction force may be developed to resist lateral movement of the anvil during impact delivery, such friction force produced as by preliminary engagement of anvil guide means with the work surface, in the manner to be described.

In its system aspects, the invention typically includes first means at one side of the work applying back-up force to the rivet head; and second means at the opposite side of the work for delivering an impact to the rivet shank terminal in a direction tending to urge that terminal toward the work bore, and with sufficient impact velocity as to radially expand and axially shorten the bulk of the terminal, thereby to form an upset engaging the opposite side of the work while the head extends closely adjacent said one side of the work. Such second means may, with unusual advantage, include an element, such as the described anvil, confining the tip of the rivet shank terminal against radial expansion during the formation of the upset; also, a tubular part may extend about the anvil in guiding relation, and engage the work to develop frictional force resisting lateral displacement of the element and rivet terminal during impact delivery.

These and other objects and advantages of the invention, as well as the details of an illustrative embodiment, will be more fully understood from the following description and drawings, in which:

DRAWING DESCRIPTION

DETAILED DESCRIPTION

Figure 1:
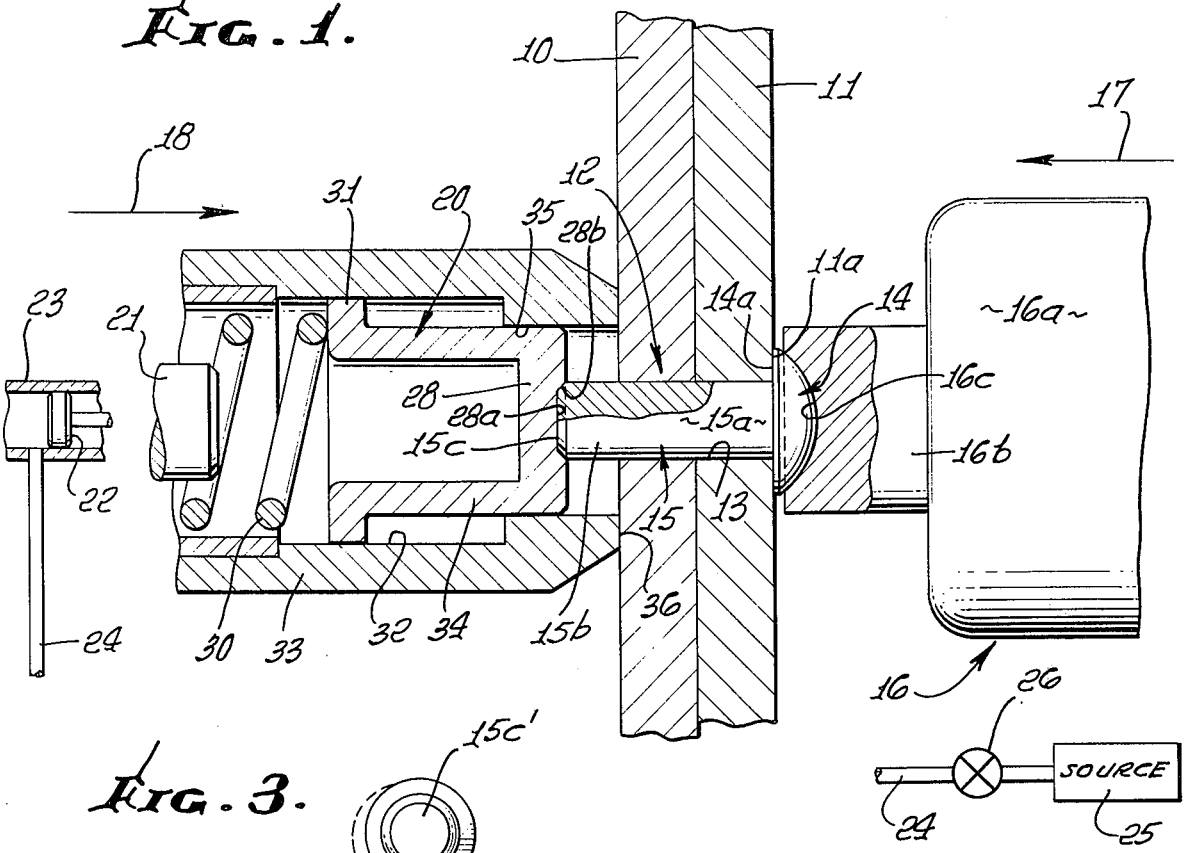
FIG. 1 is a side elevation, in section, showing a system incorporating the invention, just prior to upset formation.

In the drawings, the work is shown in the form of two panels or skins 10 and 11 to be interconnected as by a rivet or rivets 12; however, the work may take other forms. The rivet is shown in FIG. 1 as inserted into a bore 13 that extends through both panels, with the rivet head 14 at one side of the work. The shank 15 includes a portion **15*a* within the bore, a terminal portion 15*b* protruding from the bore at the opposite side of the work, and a tip at 15*c*. The rivet may have loose fit, push fit or other fit in the bore, as desired, In this environment, a system for securing the rivet to the work includes first means at one (right) side of the work applying back-up force to the rivet head tending to urge the head toward the work. Such first means may for example include a so called bucking bar 16, having a heavy metallic mass or body 16*a* and a terminal 16*b* that may be concavely recessed at 16*c* to fit the domed curvature of the rivet head. Force exerted via the bucking bar, as indicated by arrow 17, is transmitted to the head 14, and then to the work panel 11 tending to keep the inner face 14*a* of the head engaged with side 11*a*** of that panel. Such steady force may, for example, be less than 50 pounds.

Figure 2:
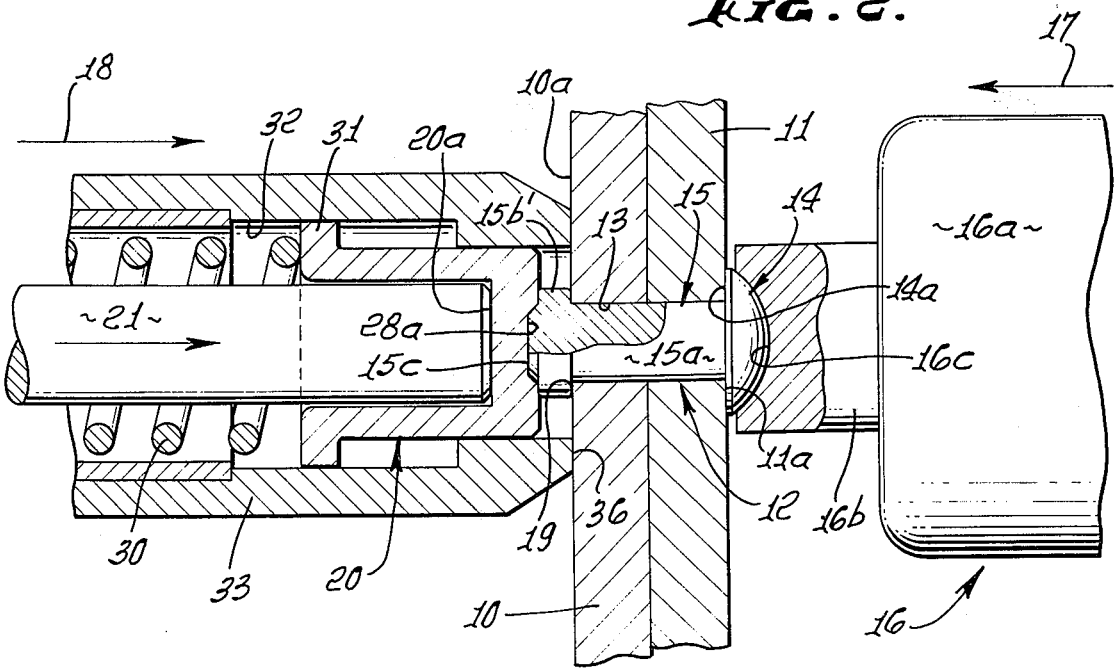
FIG. 2 is a view like FIG. 1 showing the system near the end of upset formation.

The system also includes second means at the opposite (left) side of the work for delivering an impact to the rivet shank terminal **15*b* in a longitudinal axial direction (indicated by arrow 18) tending to urge that terminal toward bore 13, and with sufficient impact velocity as to radially expand and axially shorten the bulk of the terminal, thereby to form an upset (as at 15*b*' in FIG. 2) engaging the opposite side of the work (as at 19 in FIG. 2) while the head 14 extends or remains closely adjacent the one side of the work, as at surface 11***a*. The upset is preferably formed in response primarily to only a single impact, as described, so that the rivet does not oscillate in bore 13, and the time required to form the upset is minimized. Also, impact force is utilized to form the upset rather than being substantially dissipated by transmission via the rivet head to the work, as in the past. Note that the head surface 14*a* remains engaged against the work surface 11*a* during completion of upset formation, whereby a tight rivet connection to the work is always assured. These conditions may be met when the velocity of impact exceeds about 800 to 1,000 feet per second. Merely as illustrative, the materials of the rivet and panels may be selected from the group consisting of aluminum, aluminum alloys, titanium and titanium alloys, and other ferrous and non-ferrous metals and alloys.

The referenced second means may, with unusual advantage, include an element such as anvil 20 engaging the tip 15*c* of the rivet shank terminal, and a plunger 21 to deliver the high velocity impact to the anvil at inner surface 20*a* thereof for impact transfer to the rivet end. A rivet gun may be employed and may include the anvil and plunger or striker. In this regard, a piston to drive the plunger is schematically indicated at 22 as movable in a cylinder 23, pressurized gas being delivered to the cylinder via line 24. Pressure delivery to line 24, as from source 25, may be valve controlled at 26 at the side of the work panels opposite the plunger 21, so that the worker who applies the bucking bar 16 can control the application of impact force to the rivet, preventing inadvertent impact delivery to the rivet prior to his application of the bar 16 to the rivet head; otherwise, such impact delivery could "shoot" the rivet from the work and possibly injure personnel.

Figure 3:
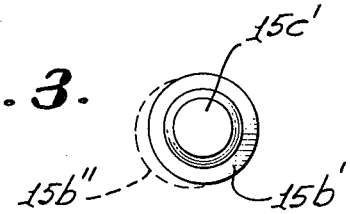
FIG. 3 is an end view of the formed upset at the end of the rivet.

A further aspect of the invention concerns the step of confining the tip 15*c* of the rivet terminal against radial expansion while the bulk of the terminal 15*b* undergoes such expansion to form the upset, thereby to form a centering indicator at the tip of the rivet. See in this regard the example of such an indicator at 15*c'* in FIG. 3. An inspector can very quickly ascertain, by viewing the indicator 15*c'*, whether it is concentric as related to the expanded upset 15*b'*. If it is concentric, the upset is correctly formed, whereas if it is not concentric, (as for example oval shaped, as indicated by broken lines 15*b''*), the existence of an out-of-round condition of the upset and its azimuthal bulge direction, are immediately evident, in relation to the location of the indicator 15*c'* which always remains centered.

For the above purpose, the above referenced second means may include an element such as the end wall 28 of the anvil 20. Wall 28 forms a centered recess 28*a* shaped to receive and confine the rivet tip 15*c* during the impact delivery, via that tip, to the rivet terminal portion 15*b* subjected to radial expansion and axial compression. Annular tapered wall 28*b* of the recess blocks radial expansion of the tip during the formation of the upset.

Maintenance of the recess 28*a* in centered and centering engagement with the tip 15*c* may be achieved, in unusually advantageous and simple manner as described below. Firstly, preliminary interfitting of the anvil and shank tip, as described, as aided by compression spring 30, urges the anvil toward the rivet. Note that the end of spring 30 engages the anvil flange 31, which is guided by a counterbore wall 32 in tubular part or sleeve 33 for axial movement; also, the anvil skirt 34 may have axial guided engagement with bore wall 35 in the part 33, for centering purposes. Initially, therefore, the anvil recess 28*a* receives the rivet tip 15*c* and the sleeve 33 is thereby centered in relation to the rivet as the sleeve terminal 36 is pushed into forcible engagement with the work surface 10*a*. Such engagement is thereafter forcibly maintained during formation of the upset 15*b'*, and the force transmitted between sleeve terminal 36 and wall 10*a* develops frictional force resisting lateral displacement of the sleeve, anvil and rivet terminal during upset formation, further facilitating the maintenance of the centered conditions as described. Accordingly, problems of malformation of the upset are eliminated or minimized.

The sleeve 33, anvil 34, spring 30, and striker 21 may be considered as incorporated in, or as defining, a riveting gun, which may also include cylinder 23 and piston 22.

I claim:

1. In the method of securing a metallic rivet to work containing a through bore, the rivet having a head at one side of the work, an axially extending shank extending through the bore, the shank having a terminal protruding at the opposite side of the work, the terminal having a tip, there being an anvil and a driver, the anvil having a recess at one side thereof shaped to interfit said tip, the steps that include a. applying back-up force to the rivet head tending to urge the head toward the work, and interfitting said tip into said anvil recess, and b. thereafter delivering an impact from the driver to the anvil and then to the rivet shank terminal via said tip in a direction tending to urge said terminal toward said bore, but with sufficient impact velocity as to radially expand and axially shorten the bulk of said terminal, thereby to form an upset engaging said opposite side of the work while the head remains in close adjacency to said one side of the work.

2. The method of claim 1 wherein said upset is formed in response to primarily only a single impact, as defined.

3. The method of claim 1 wherein said rivet consists of material selected from the group consisting of aluminum, aluminum alloys, titanium and titanium alloys, and ferrous metals and alloys.

4. The method of claim 1 wherein the work comprises first and second parallel panels to be rivet connected, and including the step of initially exerting force tending to urge the panels toward one another.

5. The method of claim 4 wherein said initial force exertion is effected via the rivet head and also at a location radially outwardly spaced from the rivet shank terminal.

6. The method of claim 2 wherein said impact velocity is at least about 800 to 1,000 feet per second.

7. The method of claim 6 wherein said impact velocity is sufficiently high in relation to the magnitude of said back-up force that said upset is formed while said head is maintained closely adjacent said one side of the work.

8. The method of claim 1 including the step of confining the tip of said rivet terminal in said anvil recess against radial expansion while said bulk of the terminal undergoes said radial expansion beyond the radial dimension of the recess, thereby to form a centering indicator at the tip of the upset.

9. The method of claim 1 wherein said back-up force is continuously exerted during said impact delivery.

10. The method of claim 1 wherein said interfitting of the anvil and rivet shank terminal tip is carried out by locating the anvil to receive the tip, and then yieldably urging the anvil toward and against the tip while maintaining the driver spaced from the anvil.

11. The method of claim 10 including means for guiding the anvil for longitudinal movement to effect upsetting of the rivet terminal in response to said impact delivery, and including the step of preliminarily engaging said means with the work to develop frictional force tending to resist lateral movement of said means and anvil during impact delivery.

12. In a system for securing a metallic rivet to work containing a through bore, the rivet having a head at one side of the work and an axially extending shank extending through the bore, the shank having a terminal protruding at the opposite side of the work, the terminal having a tip, the combination comprising a. first means at said one side of the work applying back-up force to the rivet head tending to urge the head toward the work, and b. second means at said opposite side of the work for delivering an impact to the rivet shank terminal in a direction tending to urge said terminal toward said bore, and with sufficient impact velocity as to radially expand and axially shorten the bulk of the terminal, thereby to form an upset engaging said opposite side of the work while the head extends closely adjacent said one side of the work, said second means including an anvil defining a recess interfitting and confining the tip of said shank terminal against radial expansion during the formation of said upset.

13. The combination of claim 12 wherein said second means comprises a rivet gun having a plunger to deliver said impact, a piston to drive the plunger, and a source of fluid pressure to drive said piston and plunger toward the rivet head at a velocity of at least about 800 to 1,000 feet per second to deliver a single impact to the rivet terminal for forming said upset.

14. The combination of claim 13 including a longitudinal tubular part extending about said element and engaging the work to transmit force thereto and to develop frictional force resisting lateral displacement of said element and the rivet terminal during impact delivery, said anvil having a rear flange in sliding engagement with a bore defined by said part, the anvil being tubular to receive the plunger.

15. The combination of claim 14 including the work in the form of parallel panels one of which is urged toward the other by said tubular part during the delivery of said impact.

16. The method of claim 1 including controlling, at said one side of the work, the delivery of said impact at said opposite side of the work so that said back-up force may be assuredly applied prior to said impact delivery.

* * * * *